US010072540B2

(12) United States Patent
Koyama

(10) Patent No.: US 10,072,540 B2
(45) Date of Patent: Sep. 11, 2018

(54) VARIABLE VALVE TIMING MECHANISM AND ENGINE WITH VARIABLE VALVE TIMING MECHANISM

(71) Applicant: YANMAR CO., LTD., Osaka-shi, Osaka (JP)

(72) Inventor: Hitoshi Koyama, Osaka (JP)

(73) Assignee: Yanmar Co., Ltd., Osaka-shi (JP)

( * ) Notice: Subject to any disclaimer, the term of this patent is extended or adjusted under 35 U.S.C. 154(b) by 165 days.

(21) Appl. No.: 15/031,718

(22) PCT Filed: Oct. 7, 2014

(86) PCT No.: PCT/JP2014/076744
§ 371 (c)(1),
(2) Date: Apr. 22, 2016

(87) PCT Pub. No.: WO2015/060117
PCT Pub. Date: Apr. 30, 2015

(65) Prior Publication Data

US 2016/0265398 A1 Sep. 15, 2016

(30) Foreign Application Priority Data

Oct. 25, 2013 (JP) ..... 2013-222787
Oct. 25, 2013 (JP) ..... 2013-222788

(51) Int. Cl.
*F01L 1/34* (2006.01)
*F01L 13/00* (2006.01)
(Continued)

(52) U.S. Cl.
CPC ..... *F01L 13/0063* (2013.01); *F01L 1/053* (2013.01); *F01L 1/146* (2013.01); *F01L 1/181* (2013.01);
(Continued)

(58) Field of Classification Search
CPC ..... F01L 13/0063; F01L 1/146; F01L 1/181; F01L 1/053; F01L 2001/054;
(Continued)

(56) References Cited

FOREIGN PATENT DOCUMENTS

EP 2136054 A1 12/2009
FR 338829 A 8/1904
(Continued)

OTHER PUBLICATIONS

Extended European Search Report issued in European Patent No. 14855702.8 dated May 15, 2017.
(Continued)

*Primary Examiner* — Zelalem Eshete
(74) *Attorney, Agent, or Firm* — Norton Rose Fulbright US LLP

(57) ABSTRACT

A variable valve timing system includes an exhaust swing arm swung in accordance with rotation of a camshaft, an intake swing arm similarly swung in accordance with the rotation of the camshaft, and a swing shaft swingably supporting the exhaust swing arm and the intake swing arm. In an engine including a plurality of the variable valve timing systems, the adjacent swing shafts are coupled to each other. The engine includes a link mechanism connected to one of the swing shafts, and an actuator for moving the link mechanism. The actuator controls turning angles of all the swing shafts via the link mechanism.

15 Claims, 18 Drawing Sheets

(51) Int. Cl.

| | |
|---|---|
| ***F01L 1/14*** | (2006.01) |
| ***F01L 1/18*** | (2006.01) |
| ***F01L 1/053*** | (2006.01) |
| *F01L 1/047* | (2006.01) |

(52) U.S. Cl.
CPC ..... *F01L 13/0026* (2013.01); *F01L 2001/054* (2013.01); *F01L 2105/00* (2013.01); *F01L 2800/09* (2013.01); *F01L 2820/031* (2013.01); *F01L 2820/032* (2013.01); *F01L 2820/033* (2013.01)

(58) Field of Classification Search
CPC ..... F01L 2105/00; F01L 2820/031; F01L 2820/032; F01L 2820/033; F01L 2800/09
See application file for complete search history.

(56) References Cited

FOREIGN PATENT DOCUMENTS

| | | | |
|---|---|---|---|
| GB | 686362 | A | 1/1953 |
| GB | 782351 | A | 9/1957 |
| JP | 46-003366 | Y | 2/1971 |
| JP | 48-075917 | A | 10/1973 |
| JP | 57-059938 | U | 4/1982 |
| JP | S634312 | U | 1/1988 |
| JP | 2005-113755 | A | 4/2005 |
| JP | 2007-064253 | A | 3/2007 |
| JP | 2008-115698 | A | 5/2008 |
| JP | 2012-092841 | A | 5/2012 |

OTHER PUBLICATIONS

PCT/JP2014/076744, International Search Report, dated Jan. 13, 2015, 4 pages.

VARIABLE VALVE TIMING MECHANISM AND ENGINE WITH VARIABLE VALVE TIMING MECHANISM

TECHNICAL FIELD

The present invention relates to a technology of a variable valve timing system and an engine including variable valve timing systems.

BACKGROUND ART

Conventionally, there have been a "compression ratio" and an "expansion ratio" as design factors to determine performances of an engine. The compression ratio is a ratio of the volume before and after compression at the time of compressing the air in a cylinder. The expansion ratio is a ratio of the volume before and after expansion at the time of expanding the air (combustion gas) in the cylinder. In a general engine, the compression ratio and the expansion ratio take equal values.

An engine designed in such a manner that the expansion ratio is larger than the compression ratio is known (for example, Patent Document 1). Such an engine is called a miller cycle engine and is generally capable of adjusting opening and closing timing of an intake valve. However, in order to adjust the opening and closing timing of the intake valve, a complex link mechanism and an actuator are required, and there is sometimes a case where the timing cannot be adjusted to be optimal opening and closing timing from various factors. That is, there is sometimes a case where optimal valve timing cannot be realized. Further, there is a problem that the valve timing is varied between cylinders.

PRIOR ART DOCUMENT

Patent Document

Patent Document 1: JP-A 2012-92841 Gazette

SUMMARY OF THE INVENTION

Problems to be Solved by the Invention

An object of the present invention is to provide a variable valve timing system capable of realizing optimal valve timing. Another object of the present invention is to provide an engine including variable valve timing systems capable of reducing variation in valve timing between cylinders.

Solutions to the Problems

A first aspect of the present invention is a variable valve timing system including an exhaust swing arm swung in accordance with rotation of a camshaft, an intake swing arm similarly swung in accordance with the rotation of the camshaft, and a swing shaft swingably supporting the exhaust swing arm and the intake swing arm, where the swing shaft has an eccentric shaft portion which supports the intake swing arm and which is provided in a main shaft portion supporting the exhaust swing arm, and the main shaft portion is turnably supported by a first shaft supporter adjacent to the eccentric shaft portion and a second shaft supporter disposed away from the first shaft supporter across the intake swing arm and the exhaust swing arm.

A second aspect of the present invention is the variable valve timing system according to the first aspect, where the main shaft portion and the eccentric shaft portion are integrated.

A third aspect of the present invention is an engine including a plurality of variable valve timing systems according to the first aspect or the second aspect, where the adjacent swing shafts are coupled to each other.

A fourth aspect of the present invention is the engine according to the third aspect, where the adjacent swing shafts are coupled via a universal joint.

A fifth aspect of the present invention is the engine according to the third aspect, further including a link mechanism connected to one of the swing shafts, and an actuator for moving the link mechanism, where the actuator controls turning angles of all the swing shafts via the link mechanism.

A sixth aspect of the present invention is the engine according to the fifth aspect, further including a stopper in contact with one of the swing shafts, where the stopper restricts the turning angles of all the swing shafts.

A seventh aspect of the present invention is the engine according to the sixth aspect, further including a shim for adjusting an attachment position of the stopper, where by changing the number of the shim, the stopper adjusts the turning angles of all the swing shafts.

An eighth aspect of the present invention is the engine according to the sixth aspect, where the link mechanism is fixed to the swing shaft at the farthest end on one side, and the stopper is disposed in contact with the swing shaft at the farthest end on the other side.

Effects of the Invention

As effects of the present invention, the following effects are exerted.

According to the first aspect of the present invention, the swing shaft has the eccentric shaft portion which supports the intake swing arm and which is provided in the main shaft portion supporting the exhaust swing arm, and the main shaft portion is turnably supported by the one shaft supporter adjacent to the eccentric shaft portion and the other shaft supporter disposed away from the shaft supporter across the intake swing arm and the exhaust swing arm. Accordingly, support rigidity of the swing shaft is enhanced. Thus, backlash at the time of turning can be reduced. Therefore, optimal valve timing can be realized.

According to the second aspect of the present invention, the main shaft portion and the eccentric shaft portion are integrated. Accordingly, there is no need for an assembling task of the swing shaft. Thus, an individual difference is not generated in the swing shaft (an error due to the assembling task is not generated). Therefore, further optimal valve timing can be realized.

According to the third aspect of the present invention, the adjacent swing shafts are coupled to each other. Accordingly, the plurality of variable valve timing systems can be moved by the one link mechanism and the actuator. Thus, an individual difference is not generated in the variable valve timing system (an error due to an individual difference and an assembling task of the link mechanism or the actuator is not generated). Therefore, variation in valve timing between cylinders can be reduced.

According to the fourth aspect of the present invention, the adjacent swing shafts are coupled via the universal joint. Accordingly, displacement of a turning center of the swing shaft and a turning center of the adjacent swing shaft is permitted, and swing at the time of turning can be decreased. Therefore, the variation in the valve timing between the cylinders can be further reduced.

According to the fifth aspect of the present invention, the actuator is capable of controlling all the turning angles of all the swing shafts via the link mechanism. Accordingly, the valve timing in all the cylinders can be controlled by the one actuator via the one link mechanism. Thus, a difference is not easily generated between the valve timing (a difference due to the individual difference and the assembling task of the link mechanism or the actuator is not easily generated). Therefore, the variation in the valve timing between the cylinders can be reduced.

According to the sixth aspect of the present invention, the stopper is capable of restricting the turning angles of all the swing shafts. Accordingly, phase transition amounts of the valve timing in all the cylinders can be restricted by the one stopper. Thus, a difference is not easily generated between the valve timing (a difference due to an individual difference and an assembling task of the stopper is not easily generated). Therefore, the variation in the valve timing between the cylinders can be reduced.

According to the seventh aspect of the present invention, by changing the number of the shim, the stopper is capable of adjusting the turning angles of all the swing shafts. Accordingly, the phase transition amounts of the valve timing in all the cylinders can be adjusted by the one stopper. Thus, a difference is not easily generated between the valve timing (a difference due to an adjustment task is not easily generated). Therefore, the variation in the valve timing between the cylinders can be reduced.

According to the eighth aspect of the present invention, the link mechanism is fixed to the swing shaft at the farthest end on one side. The stopper is disposed in contact with the swing shaft at the farthest end on the other side. Accordingly, in a case where turning of all the swing shafts is restricted by the stopper, torque in one direction is applied to all the swing shafts. Thus, a difference is not easily generated between the valve timing (a difference due to backlash is not easily generated). Therefore, the variation in the valve timing between the cylinders can be reduced.

EMBODIMENTS OF THE INVENTION

Firstly, an engine 100 will be briefly described.

Figure 1:
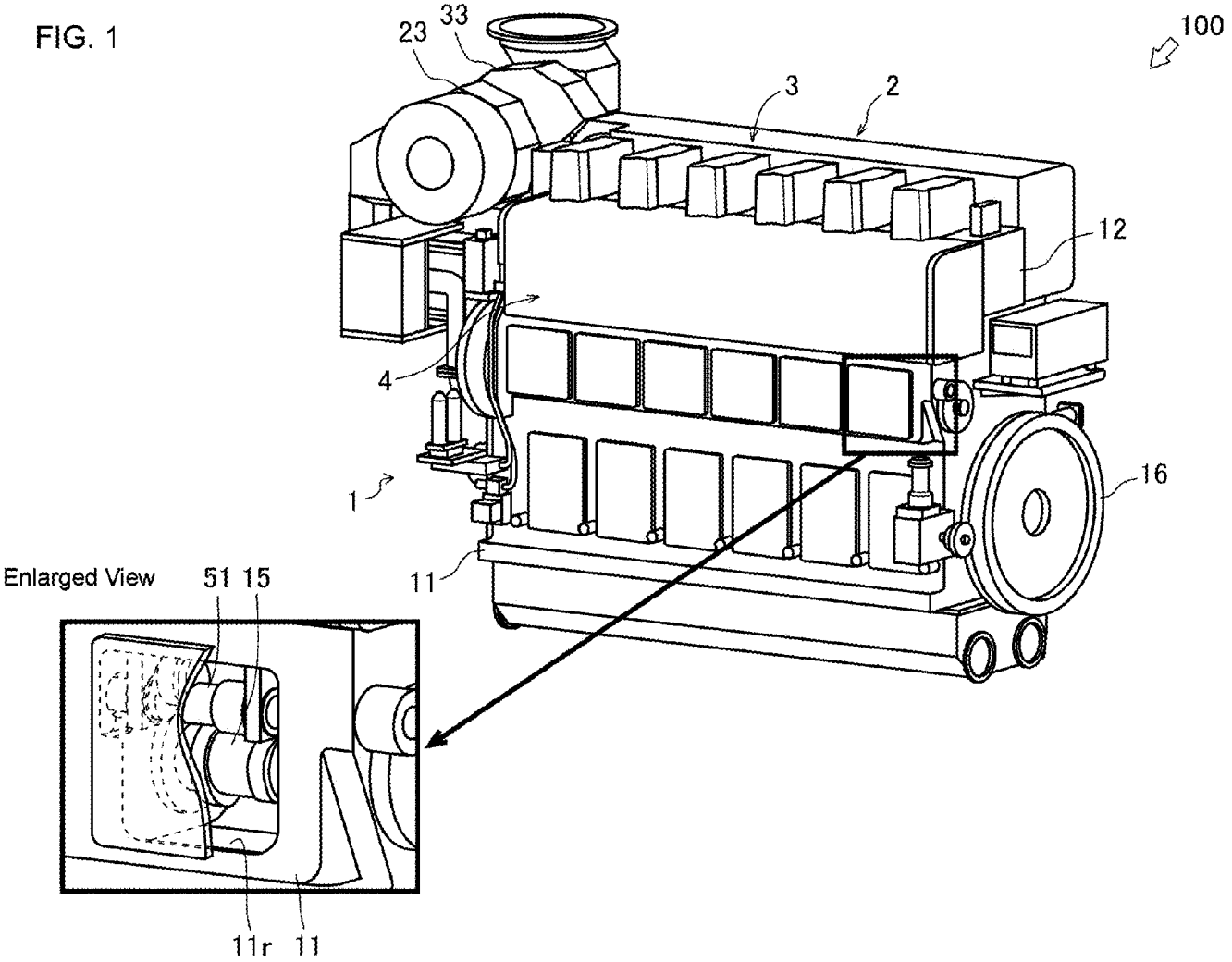
FIG. 1 shows an engine.
Figure 2:
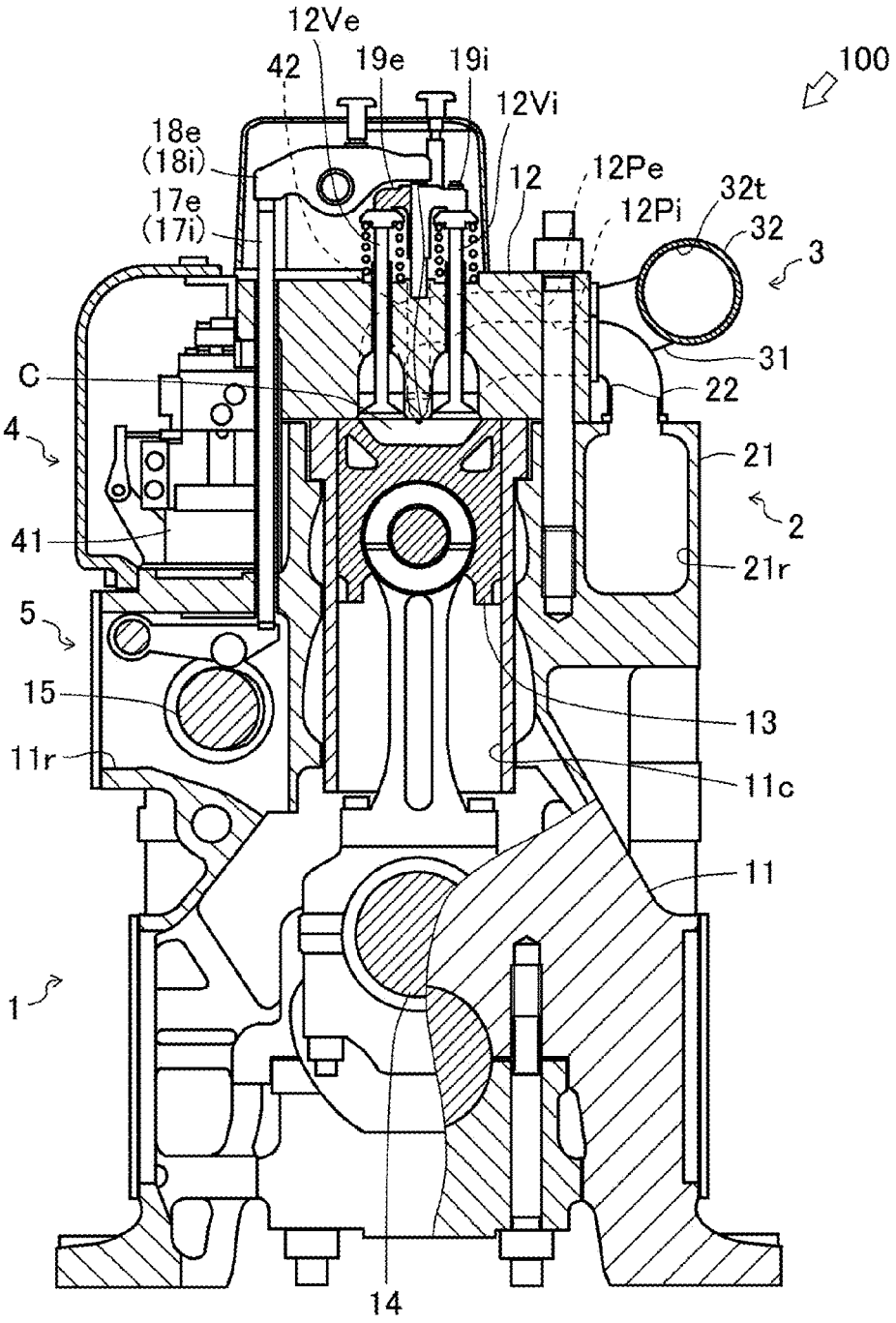
FIG. 2 shows an internal structure of the engine.

FIG. 1 shows the engine 100. FIG. 2 shows an internal structure of the engine 100.

The engine 100 mainly includes a main body portion 1, an intake route portion 2, an exhaust route portion 3, and a fuel supply portion 4.

The main body portion 1 converts energy obtained by combusting fuel into rotary motion. The main body portion 1 mainly includes a cylinder block 11, a cylinder head 12, a piston 13, a crankshaft 14, and a camshaft 15.

In the main body portion 1, a combustion chamber C is formed by a cylinder 11*c* provided in the cylinder block 11, the piston 13 slidably housed in the cylinder 11*c*, and the cylinder head 12 disposed so as to face the piston 13. In other words, the combustion chamber C indicates an internal space whose volume is changed by sliding motion of the piston 13. The piston 13 is coupled to the crankshaft 14 by a connecting rod, and the crankshaft 14 is rotated by the sliding motion of the piston 13. The crankshaft 14 rotates the camshaft 15 via a plurality of gears.

The intake route portion 2 guides the air suctioned from an exterior to the combustion chamber C. The intake route portion 2 includes a compressor wheel (not shown), an intake manifold 21, and an intake pipe 22 along the direction in which the air flows. It should be noted that the compressor wheel is housed in a housing 23.

The compressor wheel is rotated to compress the air. In the engine 100, the intake manifold 21 is integrated with the cylinder block 11. The intake manifold 21 forms an air chamber 21*r*, and the air pressurized by the compressor wheel is guided to the air chamber 21*r*. The intake pipe 22 is formed in such a manner that the air chamber 21*r* of the intake manifold 21 and an intake port 12Pi of the cylinder head 12 are connected.

The exhaust route portion 3 guides the exhaust air discharged from the combustion chamber C to the exterior. The exhaust route portion 3 includes an exhaust pipe 31, an exhaust manifold 32, and a turbine wheel (not shown) along the direction in which the exhaust air flows. It should be noted that the turbine wheel is housed in a housing 33.

The exhaust pipe 31 is formed in such a manner that an exhaust port 12Pe of the cylinder head 12 and an exhaust passage 32*t* of the exhaust manifold 32 are connected. In the engine 100, the exhaust manifold 32 is disposed on the upper side of the cylinder block 11. The exhaust manifold 32 forms the exhaust passage 32*t*, and the exhaust air led by the exhaust pipe 31 is guided to the exhaust passage 32*t*. The turbine wheel is rotated by receiving the exhaust air, and rotates the compressor wheel described above.

The fuel supply portion 4 guides fuel supplied from a fuel tank to the combustion chamber C. The fuel supply portion 4 includes a fuel injection pump 41 and a fuel injection nozzle 42 along the direction in which the fuel flows.

The fuel injection pump 41 is attached to a side part of the cylinder block 11. The fuel injection pump 41 includes a plunger sliding by rotation of the camshaft 15, and feeds the fuel by reciprocating motion of the plunger. The fuel injection nozzle 42 is attached so as to pass through the cylinder head 12. The fuel injection nozzle 42 includes a solenoid valve, and various injection patterns can be realized by adjusting timing and a period of time in which the solenoid valve runs.

Next, a running mode of the engine 100 will be briefly described.

Figure 3:
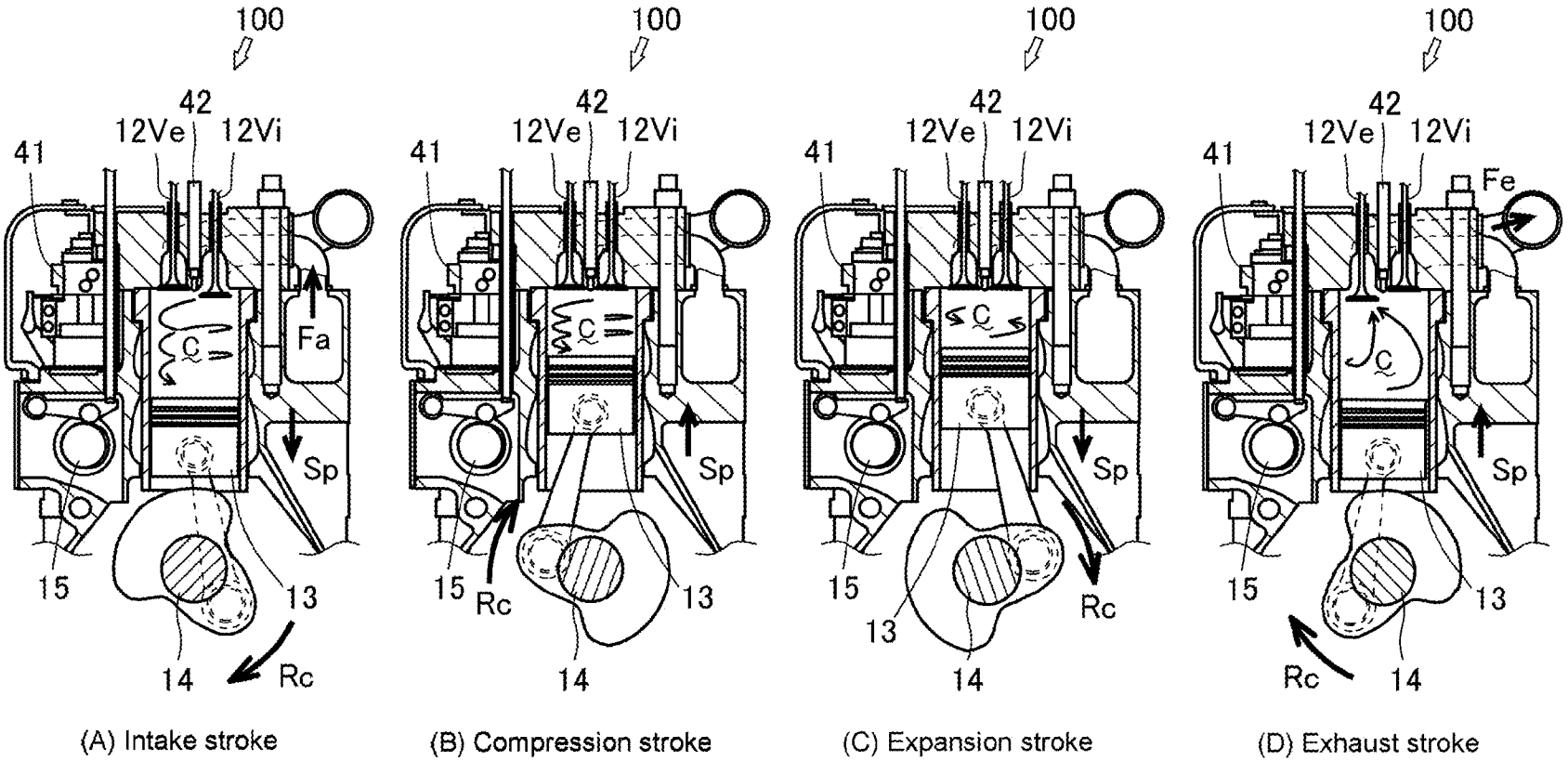
FIG. 3 shows a running mode of the engine.

FIG. 3 shows the running mode of the engine 100. It should be noted that an arrow Fa indicates the direction in which the air flows, and an arrow Fe indicates the direction in which the exhaust air flows. An arrow Sp indicates the direction in which the piston 13 slides, and an arrow Rc indicates the direction in which the crankshaft 14 is rotated.

The engine 100 is a four-stroke engine in which strokes including an intake stroke, a compression stroke, an expansion stroke, and an exhaust stroke are completed while the crankshaft 14 makes two rotations.

The intake stroke is a stroke in which an intake valve 12Vi is opened and the piston 13 slides downward, so that the air is suctioned into the combustion chamber C. The piston 13 slides by utilizing inertia moment of a rotating flywheel 16. In such a way, the engine 100 is shifted to the compression stroke.

The compression stroke is a stroke in which the intake valve 12Vi is closed and the piston 13 slides upward, so that the air in the combustion chamber C is compressed. The piston 13 slides by utilizing the inertia moment of the rotating flywheel 16. After that, the fuel is injected from the fuel injection nozzle 42 into the air compressed to have a high temperature and high pressure. Then, the fuel is dispersed, evaporated, and mixed with the air in the combustion chamber C so as to start combustion. In such a way, the engine 100 is shifted to the expansion stroke. It can be said that a compression ratio is a ratio of the volume of the combustion chamber C in which the air can be actually compressed in the compression stroke. Strictly, the compression ratio is called the "actual compression ratio".

The expansion stroke is a stroke in which the piston 13 is pushed down by the energy obtained by combusting the fuel. The piston 13 is pushed by the expanded air (combustion gas) so as to slide. At this time, motion energy of the piston 13 is converted into motion energy of the crankshaft 14. The flywheel 16 stores the motion energy of the crankshaft 14. In such a way, the engine 100 is shifted to the exhaust stroke. It can be said that an expansion ratio is a ratio of the volume of the combustion chamber C in which expansion of the air can be converted into the motion energy in the expansion stroke. Strictly, the expansion ratio is called the "actual expansion ratio".

The exhaust stroke is a stroke in which an exhaust valve 12Ve is opened and the piston 13 slides upward, so that the combustion gas in the combustion chamber C is pushed out as the exhaust air. The piston 13 slides by utilizing the inertia moment of the rotating flywheel 16. In such a way, the engine 100 is shifted to the intake stroke again.

In such a way, the engine 100 can be continuously operated by repeating the strokes including the intake stroke, the compression stroke, the expansion stroke, and the exhaust stroke.

Next, a variable valve timing system 5 adopted in the engine 100 will be described. The variable valve timing system 5 is accommodated inside the cylinder block 11. In the cylinder block 11, a housing chamber 11*r* of the variable valve timing system 5 is provided so as to project outward (refer to FIGS. 1 and 2).

Figure 4:
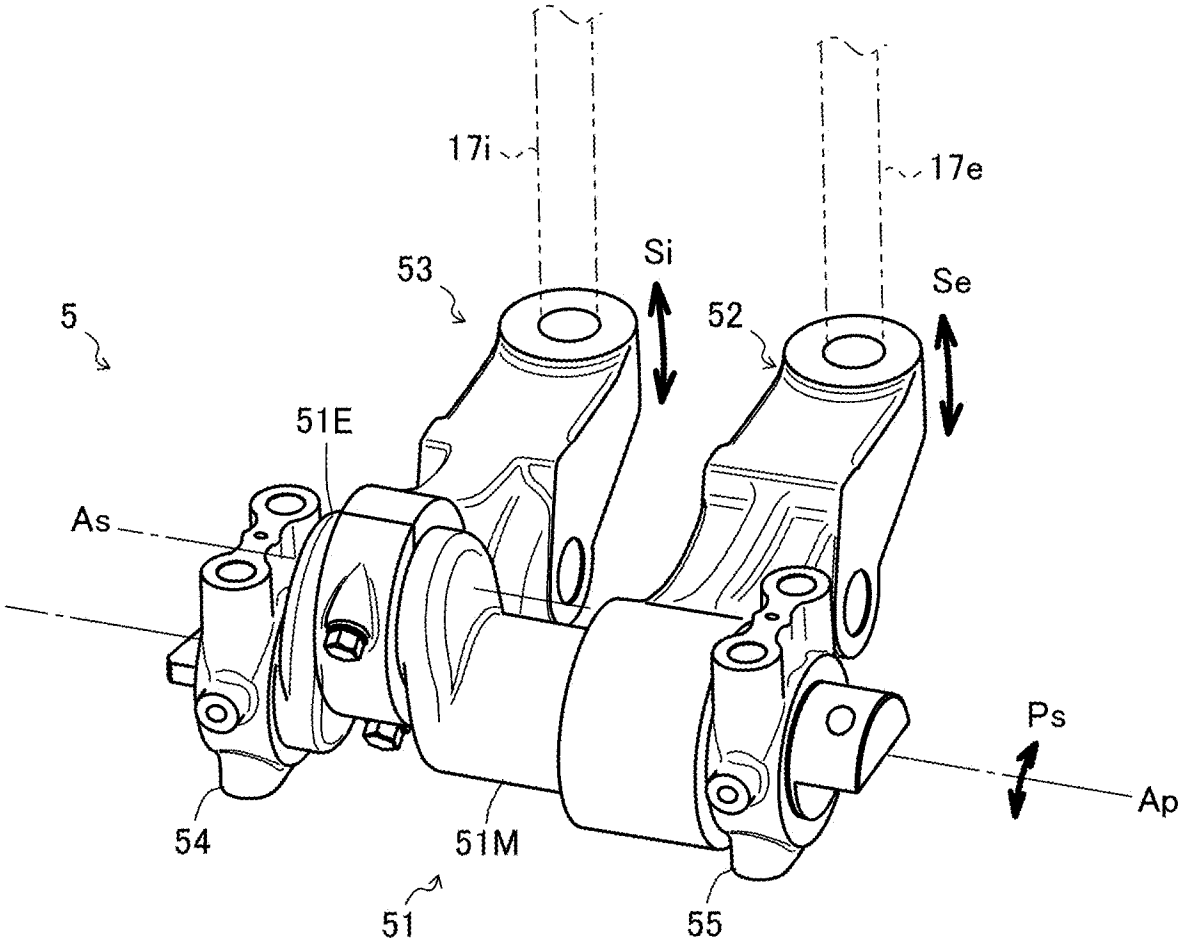
FIG. 4 shows a variable valve timing system.
Figure 5A:
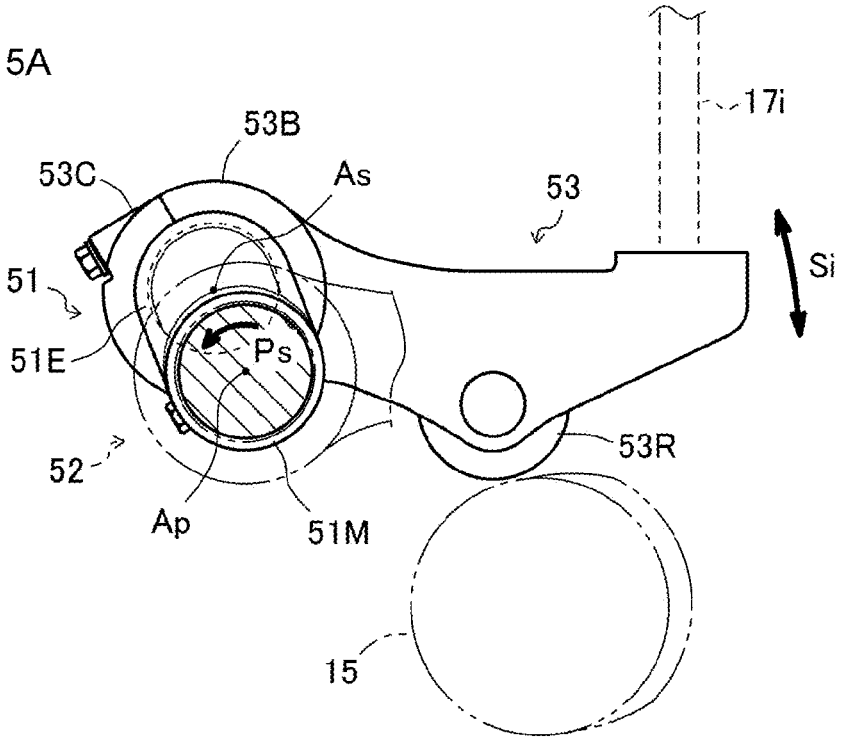
FIGS. 5A and 5B show actions of an exhaust swing arm and an intake swing arm.
Figure 5B:
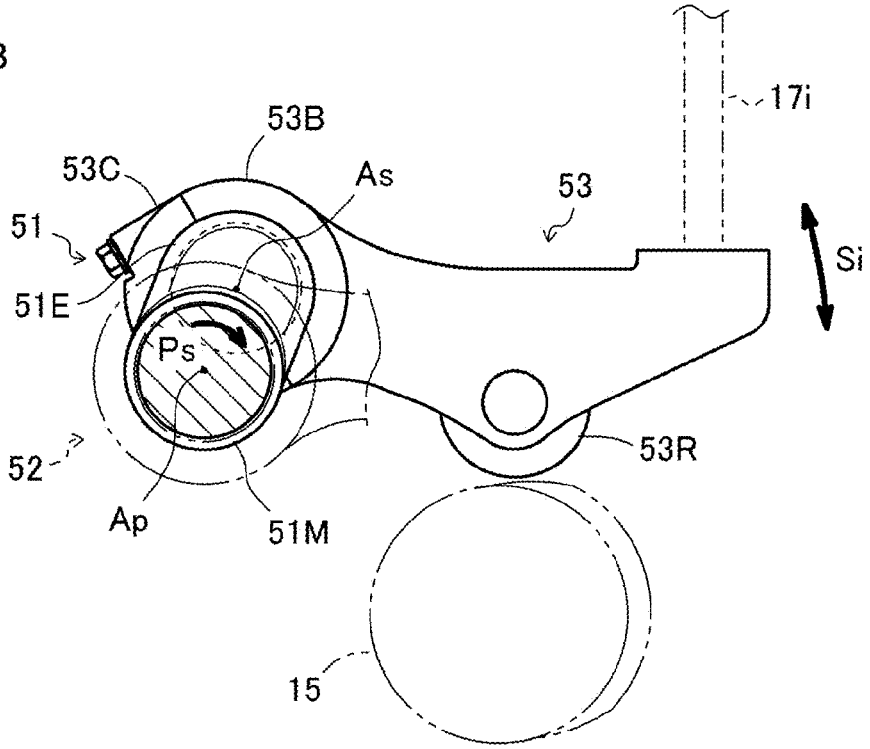
Figure 6:
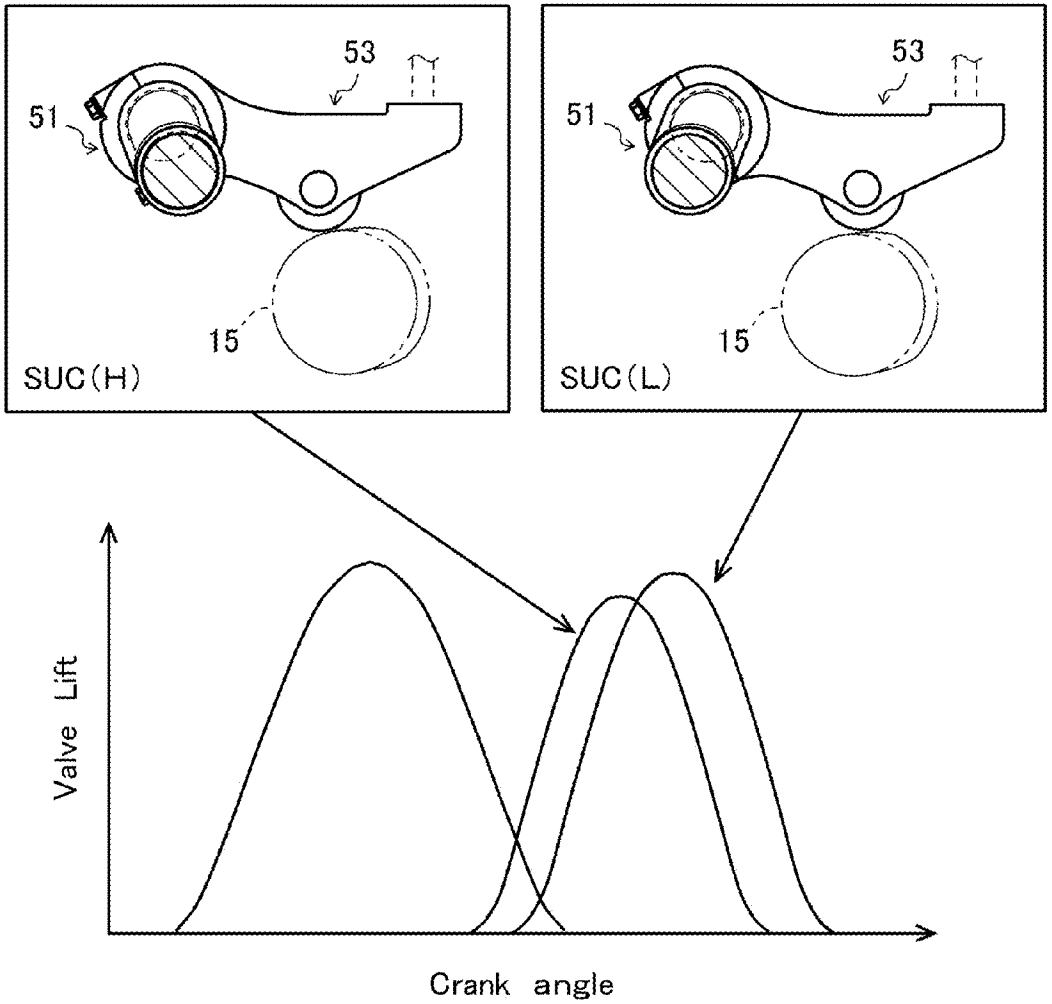
FIG. 6 shows valve timing of an exhaust valve and an intake valve.

FIG. 4 shows the variable valve timing system 5. FIGS. 5A and 5B show actions of an exhaust swing arm 52 and an intake swing arm 53. FIG. 6 shows valve timing of the exhaust valve 12Ve and the intake valve 12Vi. It should be noted that an arrow Ps indicates the direction in which a swing shaft 51 is turned. An arrow Se indicates the direction in which the exhaust swing arm 52 is swung, and an arrow Si indicates the direction in which the intake swing arm 53 is swung.

The variable valve timing system 5 mainly includes the swing shaft 51, the exhaust swing arm 52, and the intake swing arm 53. The variable valve timing system 5 also includes two shaft supporters 54 and 55. The shaft supporter 54 will be referred to as the "first shaft supporter 54", and the other shaft supporter 55 will be referred to as the "second shaft supporter 55".

In the swing shaft 51, an eccentric shaft portion 51E is integrally formed in a main shaft portion 51M serving as a main body part. That is, only one part of the swing shaft 51 is eccentric in the middle of the longitudinal direction. In general, such a shape of the swing shaft 51 is called a "crank shape". It should be noted that the swing shaft 51 is disposed in parallel to the camshaft 15.

The exhaust swing arm 52 is fitted to the main shaft portion 51M of the swing shaft 51. Therefore, the exhaust swing arm 52 is swingable about the main shaft portion 51M. A roller (not shown) is provided in the exhaust swing arm 52, and the roller is in contact with a cam face of the camshaft 15. Therefore, the exhaust swing arm 52 is swung in accordance with rotation of the camshaft 15. Then, a push rod 17*e* turns a rocker arm 18*e*, and the rocker arm 18*e* moves the exhaust valve 12Ve via a valve bridge 19*e* (refer to FIG. 2).

The intake swing arm 53 is fitted to the eccentric shaft portion 51E of the swing shaft 51. Therefore, the intake swing arm 53 is swingable about the eccentric shaft portion 51E. A roller 53R is provided in the intake swing arm 53, and the roller 53R is in contact with the cam face of the camshaft 15. Therefore, the intake swing arm 53 is swung in accordance with the rotation of the camshaft 15. Then, a push rod 17*i* turns a rocker arm 18*i*, and the rocker arm 18*i* moves the intake valve 12Vi via a valve bridge 19*i* (refer to FIG. 2).

In the swing shaft 51, the main shaft portion 51M is turnably supported by the first shaft supporter 54 and the second shaft supporter 55. Therefore, even when the swing shaft 51 is turned, a position of the main shaft portion 51M of the swing shaft 51 remains unmoved. Meanwhile, the eccentric shaft portion 51E of the swing shaft 51 is moved in accordance with turning of the swing shaft 51 (moved in the direction of the circumference about turning center Ap). That is, when the swing shaft 51 is turned, only swing center As of the intake swing arm 53 is moved. Therefore, in the intake swing arm 53, a phase of swinging motion is changed before and after the turning of the swing shaft 51. Eventually, valve timing of the intake valve 12Vi is changed.

Specifically, defining that FIG. 5A shows a state before the turning of the swing shaft 51 and FIG. 5B shows a state after the turning of the swing shaft 51, in accordance with the turning of the swing shaft 51, only the valve timing of the intake valve 12Vi is delayed (the phase is changed from a curve SUC (H) to a curve SUC (L) of FIG. 6). On the contrary, defining that FIG. 5B shows a state before the turning of the swing shaft 51 and FIG. 5A shows a state after the turning of the swing shaft 51, in accordance with the turning of the swing shaft 51, only the valve timing of the intake valve 12Vi is advanced (the phase is changed from the curve SUC (L) to the curve SUC (H) of FIG. 6).

Next, a setting process and a coupling process of the variable valve timing system 5 will be described.

Figure 7:
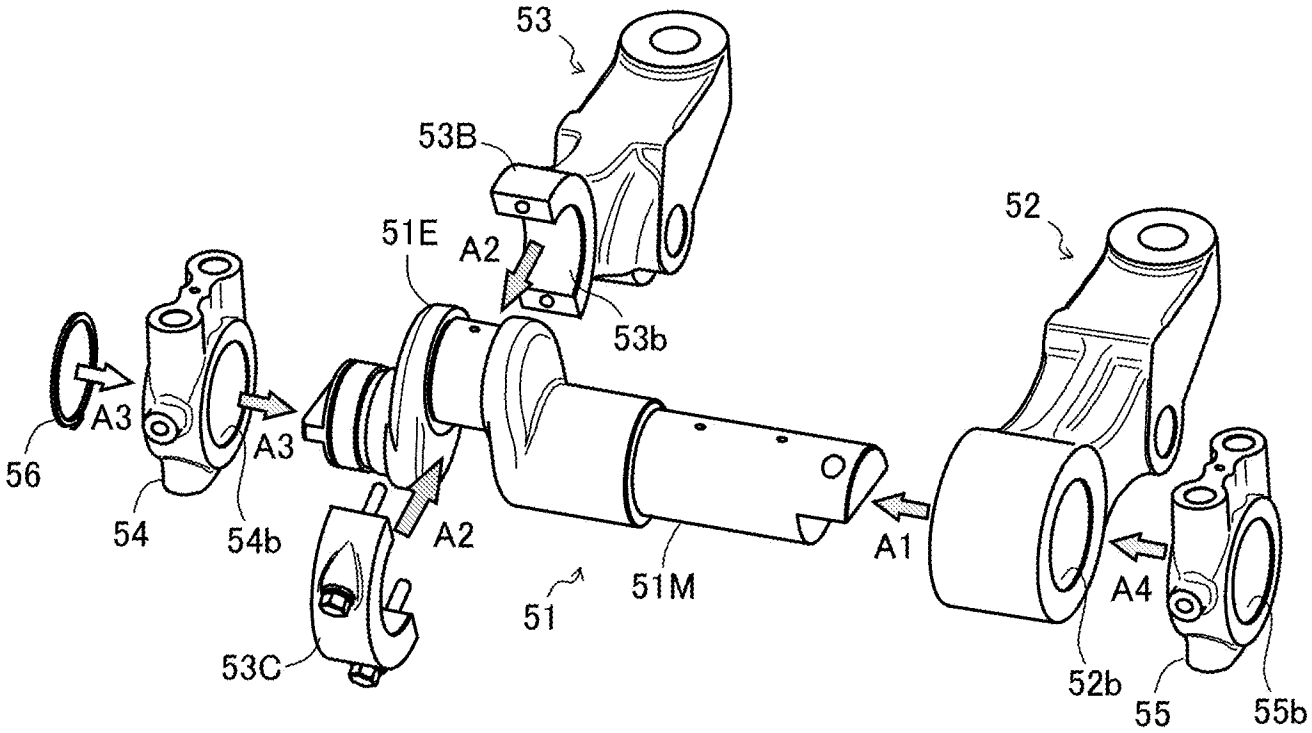
FIG. 7 shows a setting process of the variable valve timing system.
Figure 8:
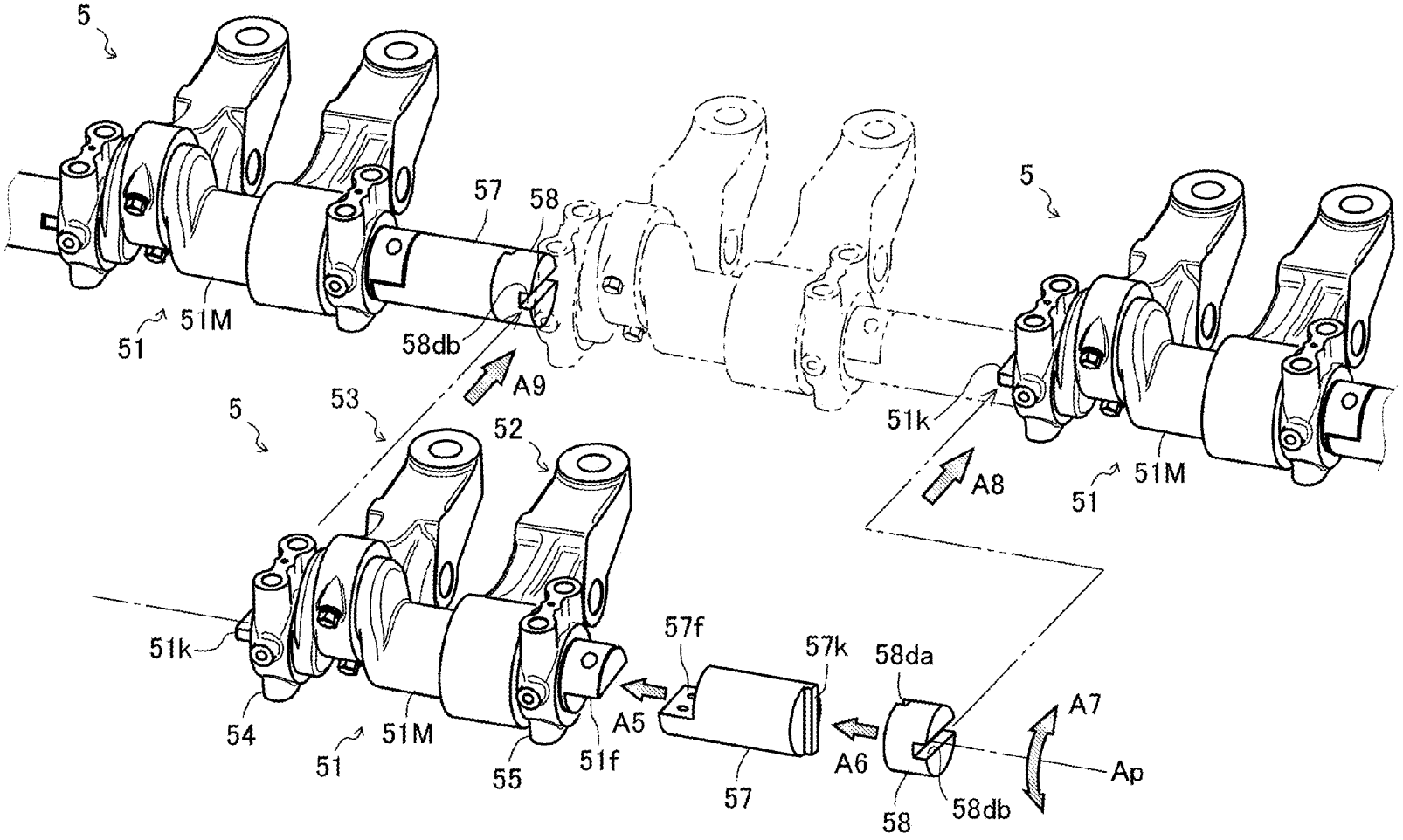
FIG. 8 shows a coupling process of the variable valve timing system.
Figure 9:
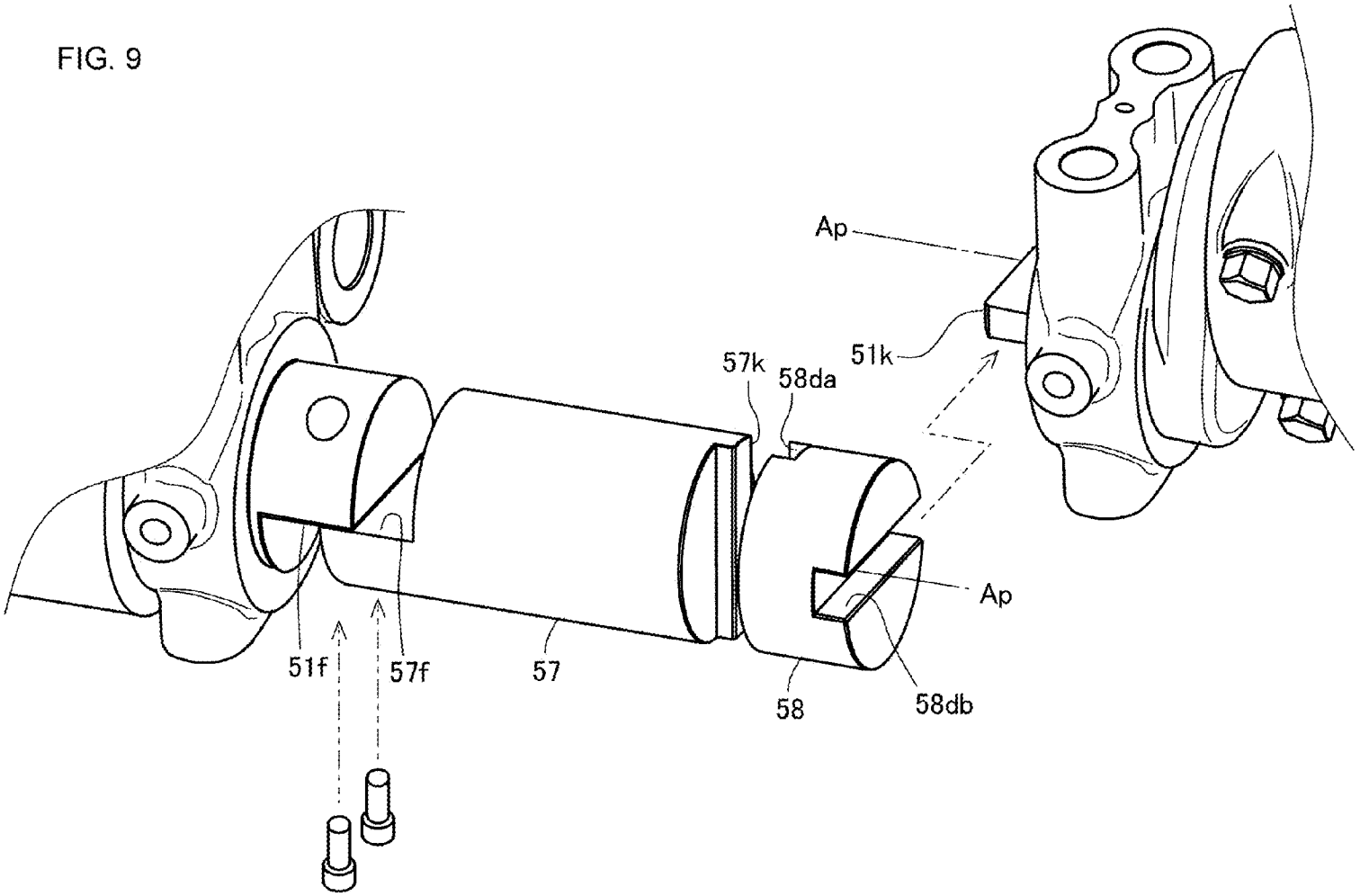
FIG. 9 shows a coupling structure of a swing shaft.

FIG. 7 shows the setting process of the variable valve timing system 5. FIG. 8 shows the coupling process of the variable valve timing system 5. FIG. 9 shows a coupling structure of the swing shaft 51.

The engine 100 is a multi-cylinder engine in which a plurality of combustion chambers C are provided. Thus, as many variable valve timing systems 5 as cylinders are required. Therefore, a worker sets the variable valve timing systems 5 one by one, and then couples the variable valve timing systems. In detail, the worker couples the swing shafts 51 adjacent to each other.

Firstly, the setting process of the variable valve timing system 5 will be described. However, the order of setting to be described below is not technically significant and does not limit to one.

At first, the worker fits the exhaust swing arm 52 to the main shaft portion 51M of the swing shaft 51. The worker overlaps a bearing 52*b* of the exhaust swing arm 52 on an extension line of the main shaft portion 51M, and fits by sliding the exhaust swing arm 52 (refer to an arrow A1).

Next, the worker attaches the intake swing arm 53 to the eccentric shaft portion 51E of the swing shaft 51. A bearing 53*b* of the intake swing arm 53 is formed into a circular shape by assembling a semi-circular bearing provided on the side of a body 53B and a semi-circular bearing provided on the side of a cap 53C. That is, the intake swing arm 53 adopts a division structure. This is because the intake swing arm 53 cannot be attached without the division structure due to integration of the main shaft portion 51M and the eccentric shaft portion 51E. The worker overlaps the body 53B and the cap 53C on a line perpendicularly crossing the eccentric shaft portion 51E, fixes the body and the cap to each other by bolts for attachment (refer to an arrow A2).

Next, the worker fits the first shaft supporter 54 to the main shaft portion 51M of the swing shaft 51. The worker overlaps a bearing 54*b* of the first shaft supporter 54 on an extension line of the main shaft portion 51M, and fits by sliding the first shaft supporter 54. The worker places a circlip 56 as a retainer (refer to an arrow A3).

Finally, the worker fits the second shaft supporter 55 to the main shaft portion 51M of the swing shaft 51. The worker overlaps a bearing 55*b* of the second shaft supporter 55 on an extension line of the main shaft portion 51M, and fits by sliding the second shaft supporter 55 (refer to an arrow A4).

In such a way, the variable valve timing system 5 is set. Characteristics of the variable valve timing system 5 are summed up as follows.

As a first characteristic, in the swing shaft 51, the eccentric shaft portion 51E supporting the intake swing arm 53 is provided in the main shaft portion 51M supporting the exhaust swing arm 52, and the main shaft portion 51M is turnably supported by the one shaft supporter 54 adjacent to the eccentric shaft portion 51E and the other shaft supporter 55 disposed away from the shaft supporter 54 across the intake swing arm 53 and the exhaust swing arm 52.

That is, in the present variable valve timing system 5, the shaft supporter 54 is disposed in the vicinity of the eccentric shaft portion 51E to which a large load is applied. Further, the intake swing arm 53 and the exhaust swing arm 52 are nipped by the shaft supporter 54 and the other shaft supporter 55, so that a both end support structure is provided. Accordingly, support rigidity of the swing shaft 51 is enhanced. Thus, backlash at the time of turning can be reduced. Therefore, optimal valve timing can be realized.

As a second characteristic, the main shaft portion 51M and the eccentric shaft portion 51E are integrated.

That is, the present variable valve timing system 5 uses the swing shaft 51 formed by preliminarily making a crank shape work and cutting only a predetermined part out from the work. Accordingly, there is no need for an assembling task of the swing shaft 51. Thus, an individual difference is not generated in the swing shaft 51 (an error due to the assembling task is not generated). Therefore, further optimal valve timing can be realized.

Next, the coupling process of the variable valve timing system 5 will be described. However, the order of coupling the variable valve timing system 5 is not technically significant and does not limit to one. A case where one variable valve timing system 5 is put between the variable valve timing systems 5 disposed on the right and left sides and the swing shafts 51 of these systems are coupled to each other will be described.

At first, the worker attaches an extension shaft 57 to the main shaft portion 51M of the swing shaft 51. The worker fits an abutment surface 57*f* of the extension shaft 57 to an abutment surface 51*f* of the main shaft portion 51M, and fixes the abutment surfaces to each other by bolts to attach (refer to an arrow A5). It should be noted that a key 57*k* is formed on an end surface of the extension shaft 57 in the direction perpendicularly crossing the turning center Ap.

Next, the worker attaches a universal joint 58 to the end surface of the extension shaft 57. A key groove 58*da* is formed on one end surface of the universal joint 58 in the direction perpendicularly crossing the turning center Ap. The worker fits the key groove 58*da* of the universal joint 58 to the key 57*k* of the extension shaft 57, and pushes the universal joint 58 in to attach (refer to an arrow A6). It should be noted that a key groove 58*db* is formed on the other end surface of the universal joint 58 in the direction perpendicularly crossing the turning center Ap and in the direction perpendicular to the key groove 58*da*.

Next, the worker matches a phase of the swing shaft 51 to be coupled to the swing shafts 51 forming the right and left variable valve timing systems 5. On the other end surface of the swing shaft 51, a key 51*k* is formed in the direction perpendicularly crossing the turning center Ap. The worker turns these swing shafts 51 to provide an appropriate phase (refer to an arrow A7). With this operation, the key groove 58*db* of the universal joint 58 and the key 51*k* of the swing shaft 51 become parallel to each other.

Finally, the worker brings the variable valve timing system 5 in between the right and left variable valve timing systems 5 while maintaining the variable valve timing system parallel to these variable valve timing systems. At this time, the key groove 58*db* of the universal joint 58 is fitted in along the key 51*k* of the swing shaft 51 (refer to an arrow A8). At the same time, the key 51*k* of the swing shaft 51 is fitted in along the key groove 58*db* of the universal joint 58 (refer to an arrow A9).

In such a way, the variable valve timing system 5 is coupled. Characteristics of the engine 100 including the present variable valve timing systems 5 are summed up as follows.

As a first characteristic, the adjacent swing shafts 51 are coupled to each other.

That is, the engine 100 is formed in such a manner that all the variable valve timing systems 5 are interlocked with each other. Accordingly, the plurality of variable valve timing systems 5 can be moved by one link mechanism 6 and an actuator 7 to be described later. Thus, an individual difference is not generated in the variable valve timing system 5 (an error due to an individual difference and an assembling task of the link mechanism 6 or the actuator 7 is not generated). Therefore, variation in the valve timing between the cylinders can be reduced.

As a second characteristic, the adjacent swing shafts 51 are coupled via the universal joint 58.

That is, the engine 100 has such a structure that the universal joint 58 sliding in one direction with respect to the extension shaft 57 attached to the swing shaft 51 and in the 90 degree direction with respect to the adjacent swing shaft 51 is used. With such a structure, even when the turning center Ap of the adjacent swing shaft 51 is displaced for some reasons, the swing shafts can be coupled to each other. In addition, displacement can be absorbed at the time of turning. Accordingly, the displacement of the turning center Ap of the swing shaft 51 and a turning center Ap of the adjacent swing shaft 51 is permitted, and swing at the time of turning can be decreased. Therefore, the variation in the valve timing between the cylinders can be further reduced.

Next, a structure for moving the variable valve timing system 5 will be described.

Figure 10:
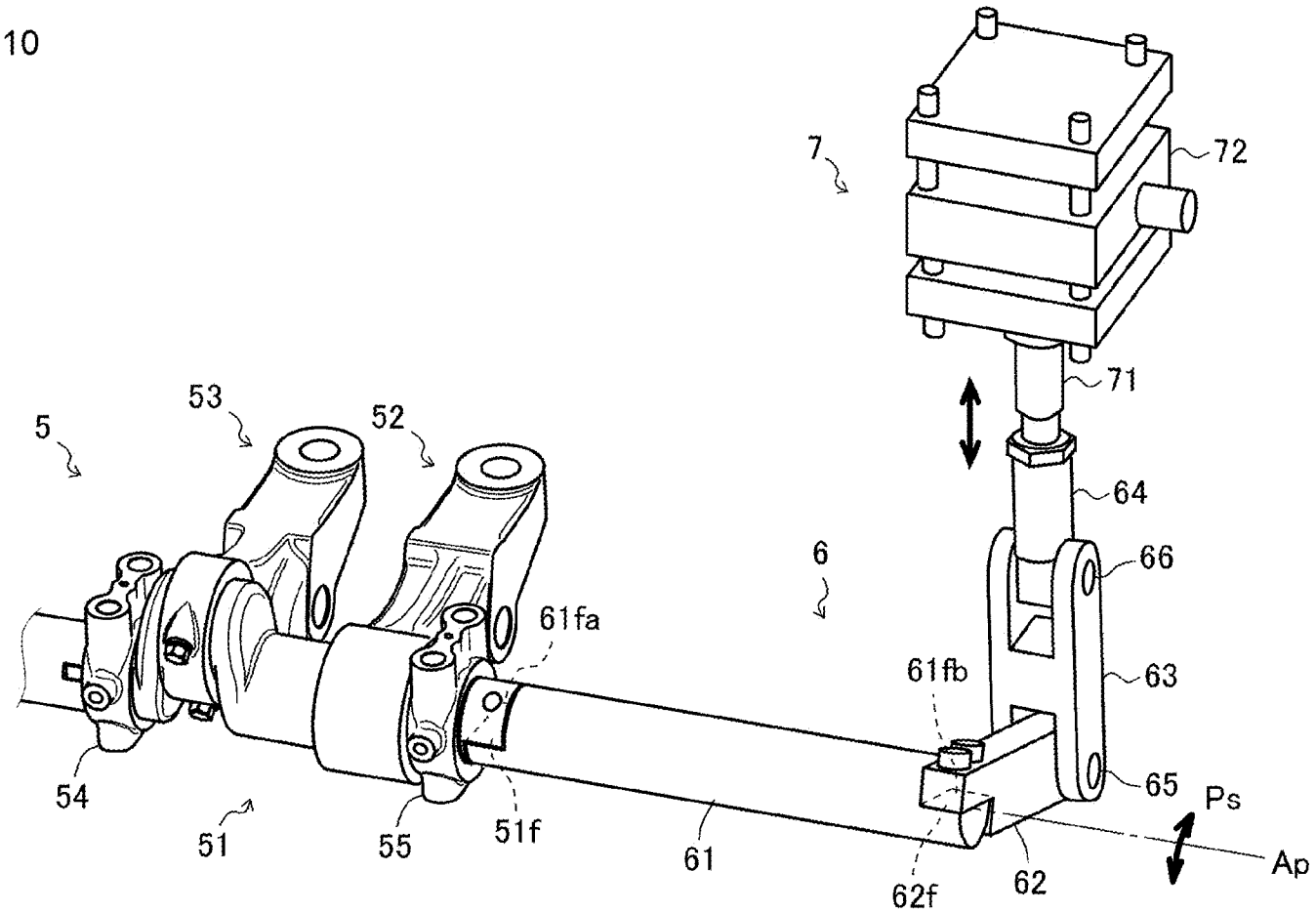
FIG. 10 shows a drive structure of the variable valve timing system.
Figure 11B:
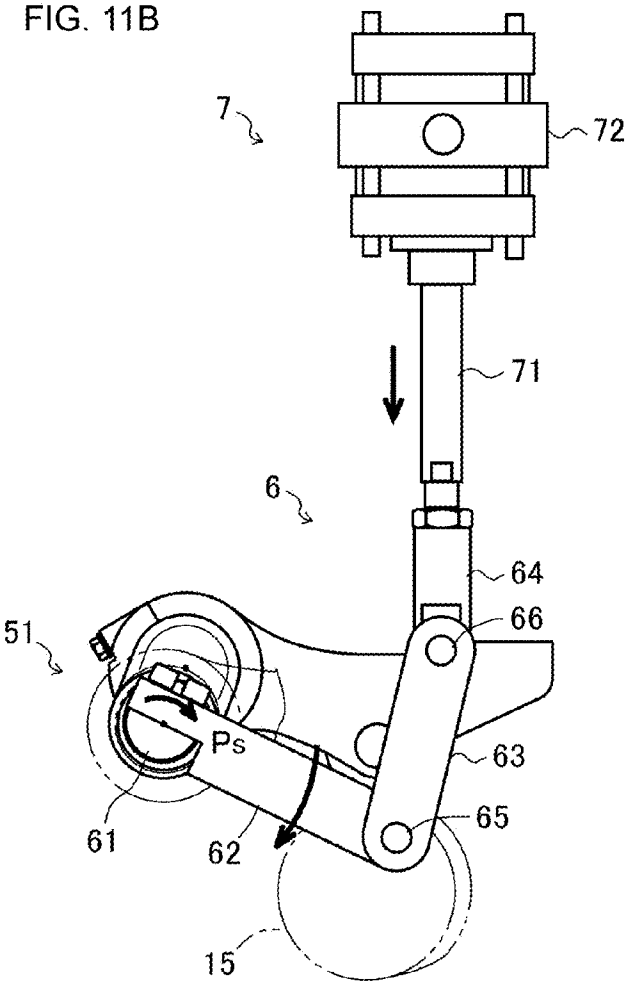
FIGS. 11A and 11B show actions of a link mechanism and an actuator.
Figure 11A:
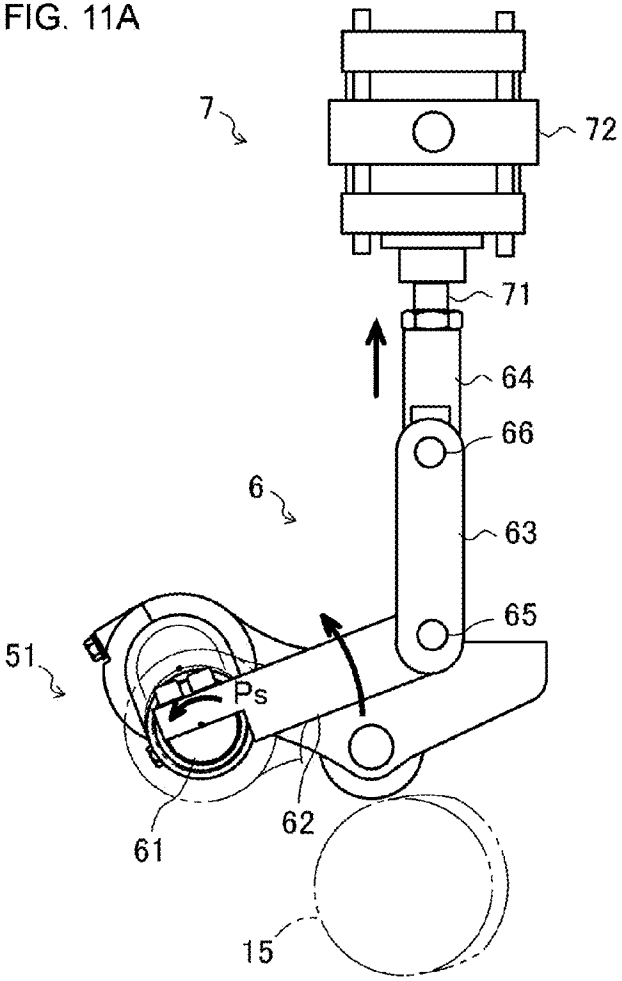

FIG. 10 shows a drive structure of the variable valve timing system 5. FIGS. 11A and 11B show actions of the link mechanism 6 and the actuator 7. It should be noted that an arrow Ps indicates the direction in which the swing shaft 51 is turned. Other arrows indicate the action directions of constituent parts.

The drive structure of the variable valve timing system 5 mainly includes the link mechanism 6 and the actuator 7. In the engine 100, the link mechanism 6 is connected to the swing shaft 51 at the farthest end on one side (on the opposite side to a stopper 8 to be described later).

The link mechanism 6 converts a spring-out action or a pull-in action of a piston rod 71 to be described later into a turning action of the swing shaft 51. The link mechanism 6 includes a link shaft 61, a link arm 62, a link plate 63, and a link rod 64.

The link shaft 61 is attached so as to extend the swing shaft 51. An abutment surface 61*fa* is provided in an end part of the link shaft 61 in parallel to the turning center Ap. Therefore, the link shaft 61 is fixed by a bolt in a state where the abutment surface 61*fa* is matched with the abutment surface 51*f* described above. It should be noted that an abutment surface 61*fb* is provided in the other end part of the link shaft 61 in parallel to the turning center Ap.

The link arm 62 is attached in the direction perpendicular to the link shaft 61. An abutment surface 62*f* is provided in an end part of the link arm 62 in parallel to the turning center Ap. Therefore, the link arm 62 is fixed by a bolt in a state where the abutment surface 62*f* is matched with the abutment surface 61*fb* described above. It should be noted that an axial hole for inserting a pin 65 is provided in the other end part of the link arm 62.

The link plate 63 is attached so as to be turned with respect to the link arm 62. Axial holes for inserting the pin 65 are provided in an end part of the link plate 63. Therefore, the link plate 63 is turnable by inserting the pin 65 in a state where the axial holes of the link plate 63 are overlapped with the axial hole of the link arm 62 described above. It should be noted that axial holes for inserting a pin 66 are provided in the other end part of the link plate 63.

The link rod 64 is attached so as to be turned with respect to the link plate 63. An axial hole for inserting the pin 66 is provided in an end part of the link rod 64. Therefore, the link rod 64 is turnable by inserting the pin 66 in a state where the axial hole of the link rod 64 is overlapped with the axial holes of the link plate 63 described above. It should be noted that a female screw portion for coupling to the piston rod 71 is provided in the other end part of the link rod 64.

The actuator 7 moves the link mechanism 6 based on an operation state of the engine 100. The actuator 7 includes the piston rod 71 and a main body 72.

The piston rod 71 is coupled to the link rod 64. A male screw portion for coupling to the link rod 64 is provided in an end part of the piston rod 71. Therefore, the piston rod 71 is fixed by a nut in a state where the male screw portion of the piston rod 71 is screwed into the female screw portion of the link rod 64 described above. It should be noted that the other end part of the piston rod 71 is inserted into the main body 72.

The main body 72 enables the spring-out action or the pull-in action of the piston rod 71. An air cylinder for moving the piston rod 71 is provided inside the main body 72. Therefore, by supplying and discharging the compressed air to and from the air cylinder, the main body 72 can move the piston rod 71. It should be noted that the present main body 72 is actuated by air pressure. However, for example, the main body may be actuated by hydraulic pressure. The main body may also be actuated by electricity. Further, the present main body 72 maintains the piston rod 71 in any of a spring-out state and a pull-in state. However, the main body may be able to maintain the piston rod in multistep or non-step.

With such a structure, for example, upon defining that FIG. 11A shows a state before the spring-out action of the piston rod 71 and FIG. 11B shows a state after the spring-out action of the piston rod 71, in accordance with the spring-out action of the piston rod 71, all the coupled swing shafts 51 are turned to one side. On the contrary, upon defining that FIG. 11B shows a state before the pull-in action of the piston rod 71 and FIG. 11A shows a state after the pull-in action of the piston rod 71, in accordance with the pull-in action of the piston rod 71, all the coupled swing shafts 51 are turned to the other side.

In such a way, the actuator 7 in the engine 100 can control turning angles of all the swing shafts 51 via the link mechanism 6. Accordingly, the valve timing in all the cylinders can be controlled by the one actuator 7 via the one link mechanism 6. Thus, a difference is not easily generated between the valve timing (a difference due to the individual difference and the assembling task of the link mechanism 6 or the actuator 7 is not easily generated). Therefore, the variation in the valve timing between the cylinders can be reduced.

Next, a structure for restricting the turning angle of the swing shaft 51 will be described.

Figure 12:
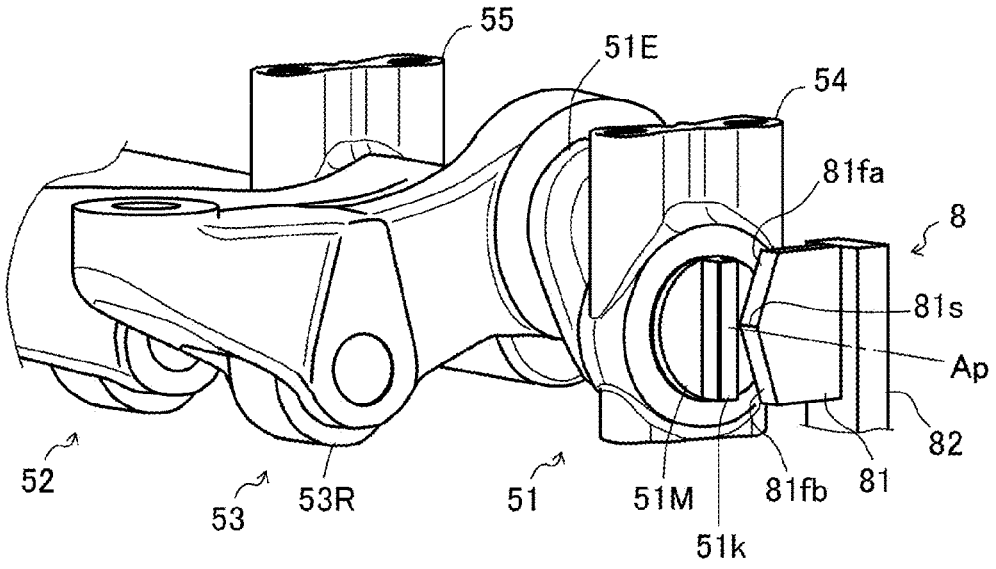
FIG. 12 shows a restricting structure of a turning angle.
Figure 13A:
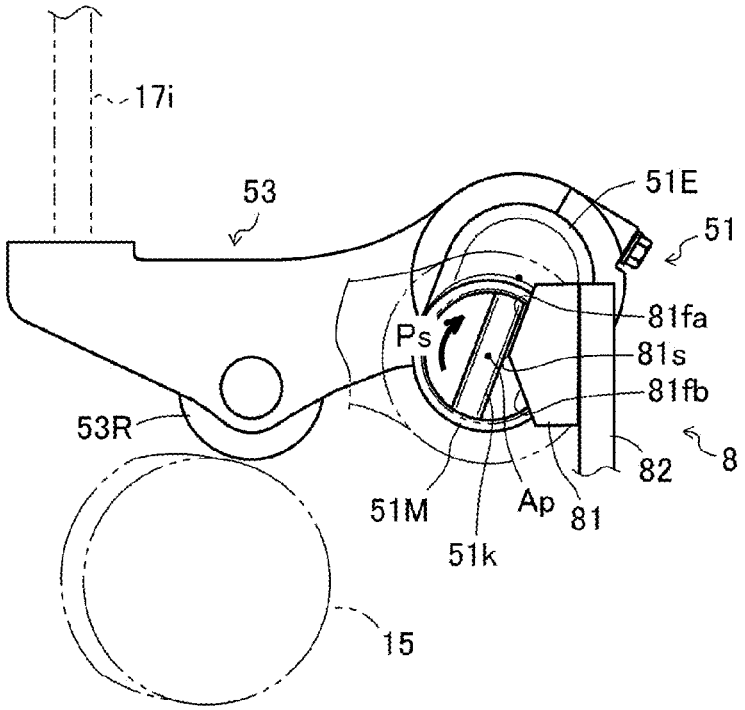
FIGS. 13A and 13B show a state where the turning angle of the swing shaft is restricted.
Figure 13B:
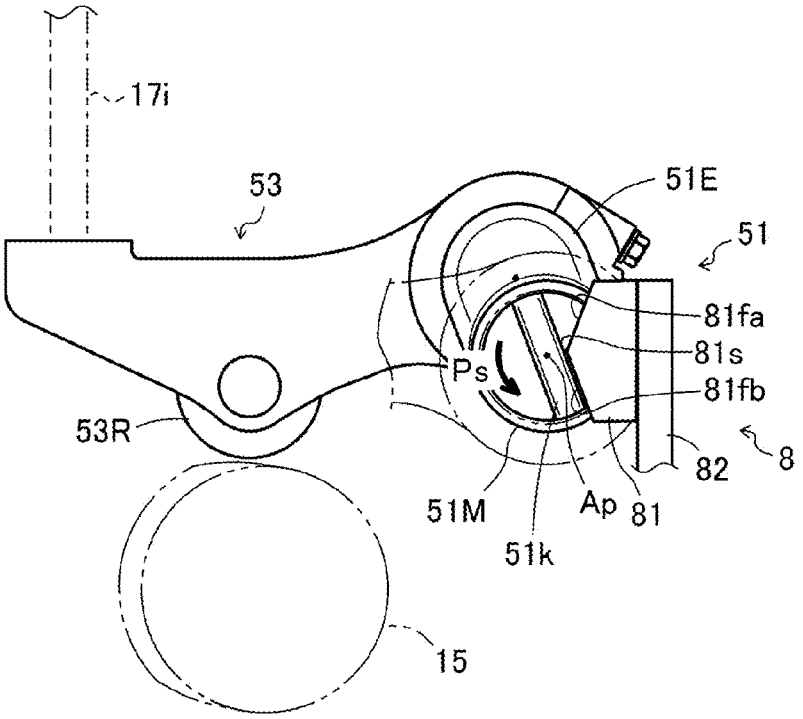

FIG. 12 shows a restricting structure of the turning angle. FIGS. 13A and 13B show a state where the turning angle of the swing shaft 51 is restricted. It should be noted that an arrow Ps indicates the direction in which the swing shaft 51 is turned.

The restricting structure of the turning angle is mainly constituted by the stopper 8. In the engine 100, the stopper 8 is disposed in contact with the swing shaft 51 at the farthest end on the other side (on the opposite side to the link mechanism 6 described above).

The stopper 8 has a structure in which a substantially pentagonal plate 81 is attached to a frame 82.

One side 81*s* in the thickness direction of the plate 81 is disposed in parallel to the turning center Ap in the vicinity of the turning center Ap. In the plate 81, an oblique surface 81*fa* and an oblique surface 81*fb* having such one side 81*s* as a top part are formed. Therefore, when the swing shaft 51 is turned to one side, the key 51*k* of the swing shaft 51 is brought into contact with the oblique surface 81*fa*. When the swing shaft 51 is turned to the other side, the key 51*k* of the swing shaft 51 is brought into contact with the oblique surface 81*fb*.

With such a structure, for example, upon defining that FIG. 13A shows a state before the turning of the swing shaft 51 and FIG. 13B shows a state after the turning of the swing shaft 51, the turning of all the coupled swing shafts 51 is stopped by contact between the key 51*k* and the oblique surface 81*fb*. On the contrary, upon defining that FIG. 13B shows a state before the turning of the swing shaft 51 and FIG. 13A shows a state after the turning of the swing shaft 51, the turning of all the coupled swing shafts 51 is stopped by contact between the key 51*k* and the oblique surface 81*fa*.

In such a way, the stopper 8 in the engine 100 can restrict the turning angles of all the swing shafts 51. Accordingly, phase transition amounts of the valve timing in all the cylinders can be restricted by the one stopper 8. Thus, a difference is not easily generated between the valve timing (a difference due to an individual difference and an assembling task of the stopper is not easily generated). Therefore, the variation in the valve timing between the cylinders can be reduced.

Next, a structure for adjusting the turning angle of the swing shaft 51 will be described.

Figure 14:
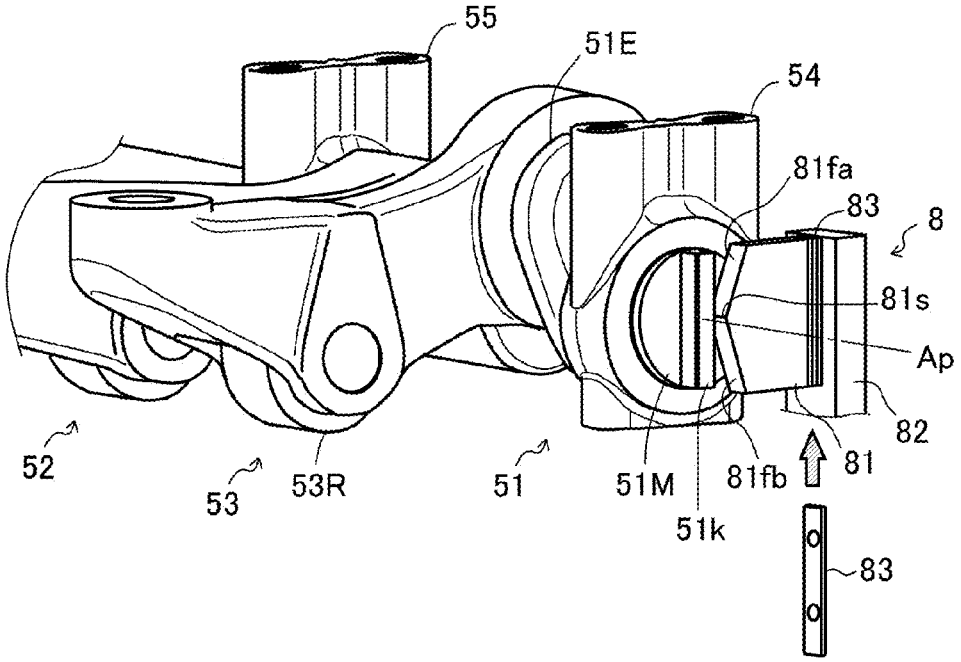
FIG. 14 shows a situation where the turning angle of the swing shaft is adjusted.

FIG. 14 shows a situation where the turning angle of the swing shaft 51 is adjusted.

As described above, the one side 81*s* in the thickness direction of the plate 81 is disposed in parallel to the turning center Ap in the vicinity of the turning center Ap. Therefore, when a distance from such one side 81*s* to the turning center Ap can be freely changed, the turning angle of the swing shaft 51 can be adjusted. Thus, the present stopper 8 has a structure in which a shim 83 can be nipped between the plate 81 and the frame 82.

In such a way, by changing the number of the shim 83, the stopper 8 in the engine 100 is capable of adjusting the turning angles of all the swing shafts 51. Accordingly, the phase transition amounts of the valve timing in all the cylinders can be adjusted by the one stopper 8. Thus, a difference is not easily generated between the valve timing (a difference due to an adjustment task is not easily generated). Therefore, the variation in the valve timing between the cylinders can be reduced.

In addition, as described above, the link mechanism 6 in the engine 100 is fixed to the swing shaft 51 at the farthest end on one side. The stopper 8 is disposed in contact with the swing shaft 51 at the farthest end on the other side. Accordingly, in a case where the turning of all the swing shafts 51 is restricted by the stopper 8, torque in one direction is applied to all the swing shafts 51. Thus, a difference is not easily generated between the valve timing (a difference due to backlash is not easily generated). Therefore, the variation in the valve timing between the cylinders can be reduced.

Next, an attachment position of the variable valve timing system 5 will be described.

Figure 15:
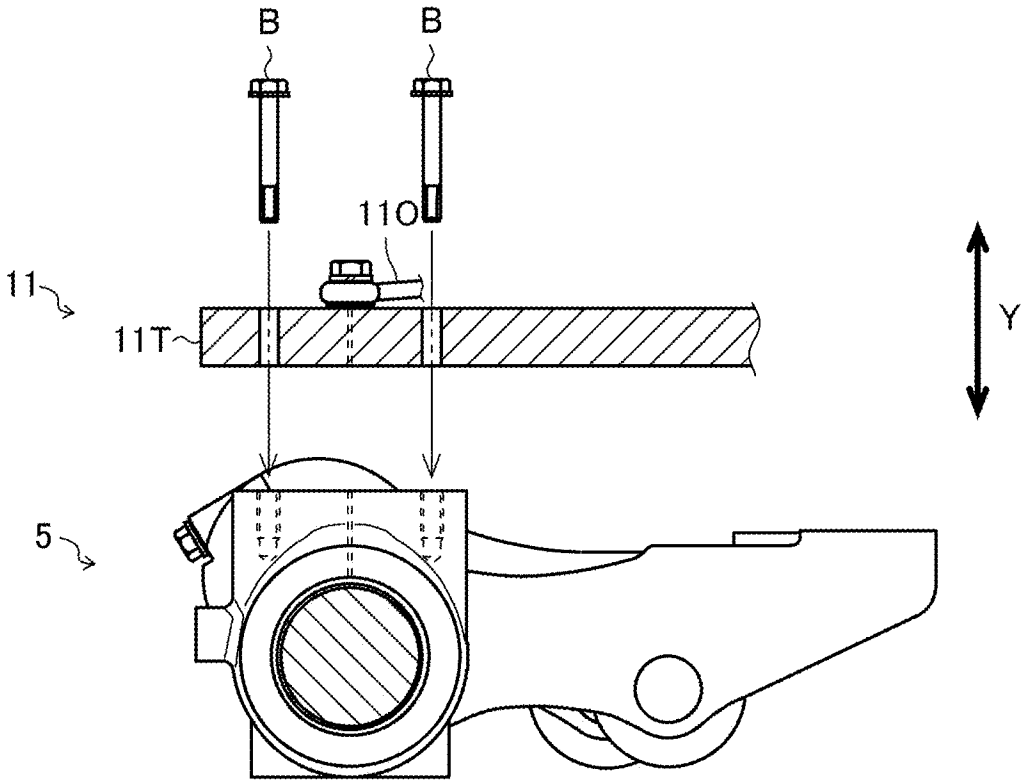
FIG. 15 shows an attachment position of the variable valve timing system.

FIG. 15 shows the attachment position of the variable valve timing system 5. It should be noted that an arrow Y indicates the up and down direction.

In the engine 100, the variable valve timing system 5 is attached to a lower surface of a top deck 11T provided in the cylinder block 11. This is because by connecting a lubricating oil pipe 11O to an upper surface of the top deck 11T, a lubricating oil route of the variable valve timing system 5 can be easily formed. That is, there is no need for forming a complicated oil passage inside the cylinder block 11 but a pipe through which lubricating oil passes may be provided outside the cylinder block 11. Thus, the lubricating oil route of the variable valve timing system 5 can be easily formed. It should be noted that the variable valve timing system 5 is fixed to the top deck 11T by bolts B via the top deck 11T.

The variable valve timing system 5 and the engine 100 including the variable valve timing systems 5 according to the embodiment of the present application are described above. Hereinafter, other embodiments will be described.

Figure 16A:
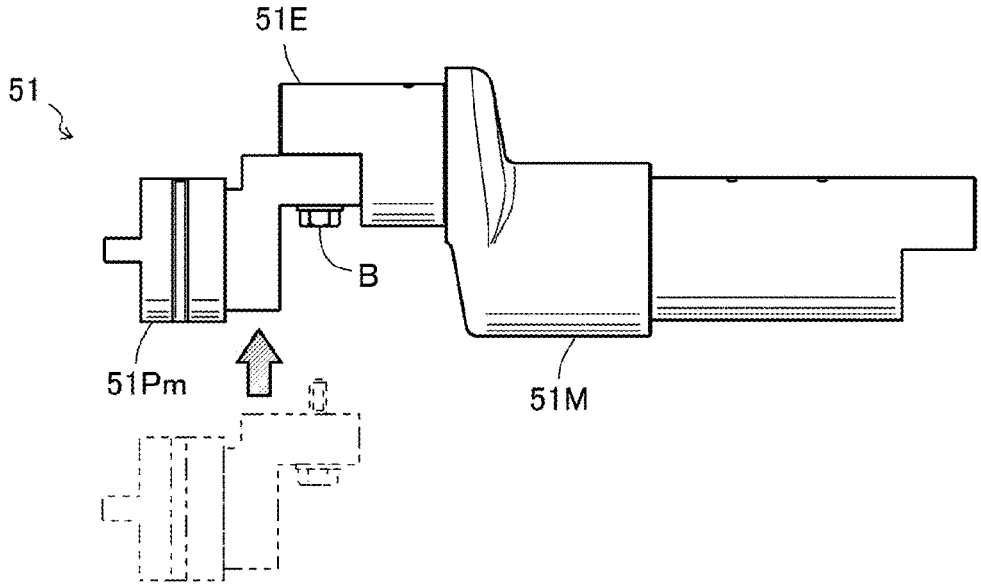
FIGS. 16A and 16B show a swing shaft according to one of other embodiments.
Figure 16B:
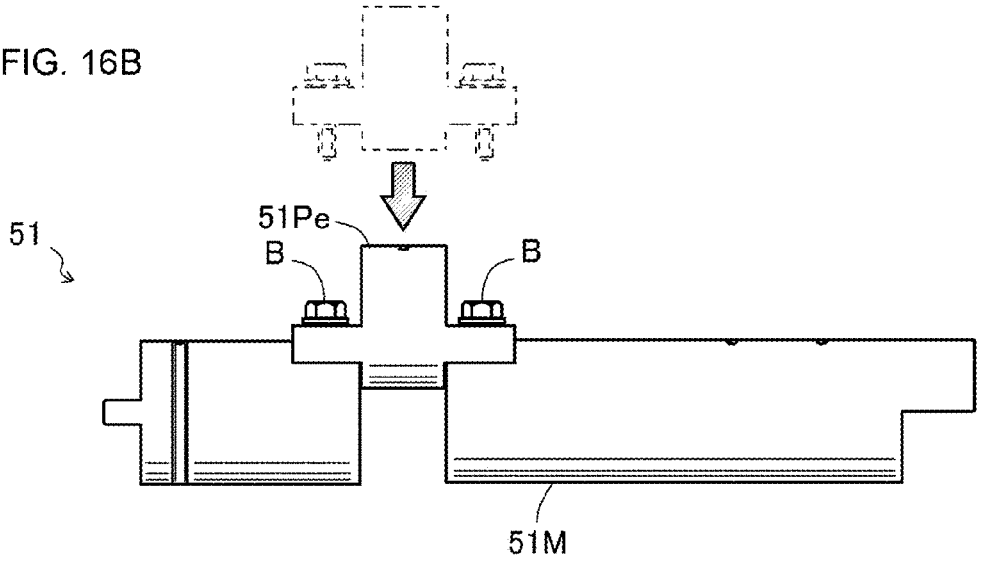

FIGS. 16A and 16B show a swing shaft 51 according to one of other embodiments.

In a swing shaft 51 shown in FIG. 16A, an eccentric shaft portion 51E is formed in one end of a main shaft portion 51M. The swing shaft has a structure in which a component 51Pm with a journal formed as the main shaft portion is attached to the eccentric shaft portion 51E. That is, such a swing shaft 51 is formed into a crank shape by attaching the component 51Pm. With such a structure, there is no need for making an intake swing arm 53 a division structure. This is because before attaching the component 51Pm, a bearing 53*b* of the intake swing arm 53 may be overlapped on an extension line of the eccentric shaft portion 51E and the intake swing arm 53 may be fitted by sliding. It should be noted that the component 51Pm is fixed to the eccentric shaft portion 51E by a bolt B.

On the other hand, a swing shaft 51 shown in FIG. 16B has a structure in which a main shaft portion 51M is divided into two and a component 51Pe serving as an eccentric shaft portion 51E is attached between the two main shaft portions. That is, such a swing shaft 51 is formed into a crank shape by attaching the component 51Pe. With such a structure, there is no need for making an intake swing arm 53 a division structure. Since a shape of the swing shaft 51 is simplified, the cost can be reduced. It should be noted that the component 51Pe is fixed to the main shaft portions 51M by bolts B.

Figure 17A:
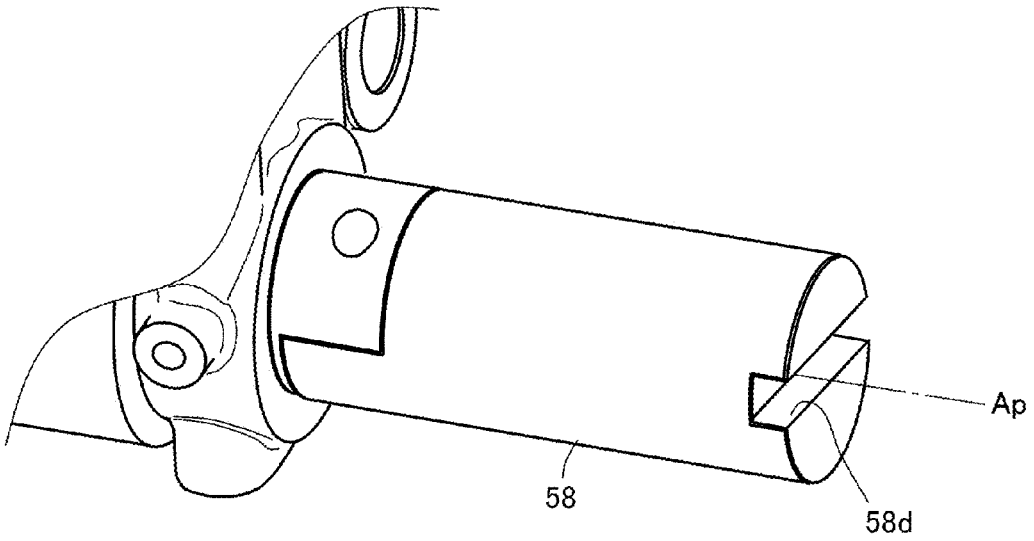
FIGS. 17A and 17B show a universal joint according to one of other embodiments.
Figure 17B:
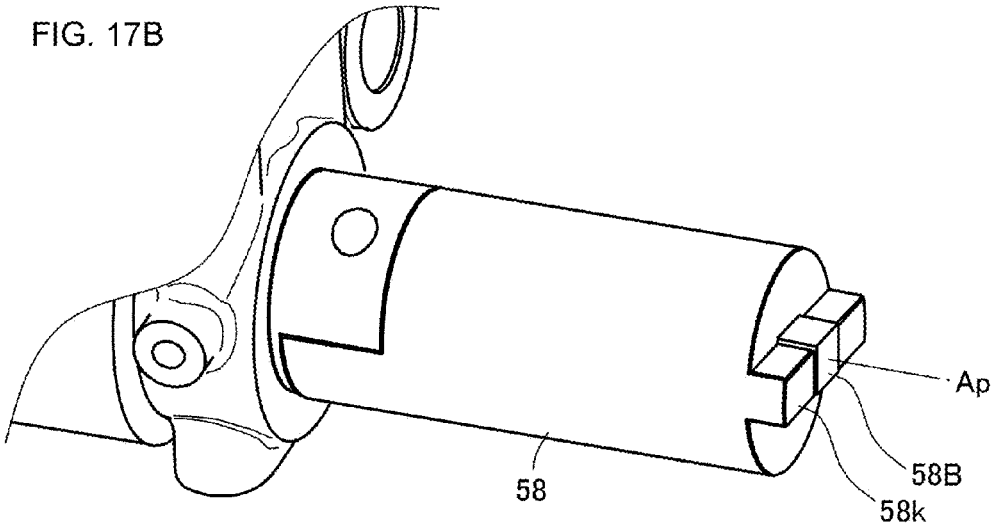

FIGS. 17A and 17B show a universal joint according to one of other embodiments.

A universal joint 58 shown in FIG. 17A is integrated with the extension shaft 57 described above. In such a universal joint 58, a key groove 58*d* is formed in the direction perpendicularly crossing the turning center Ap. With such a structure, the man-hour of the coupling process is reduced. Since the number of parts is also reduced, the cost can be reduced.

A universal joint 58 shown in FIG. 17B is also integrated with the extension shaft 57 described above. In such a universal joint 58, a key 58*k* is formed in the direction perpendicularly crossing the turning center Ap. A block 58B is fitted in center of the key 58*k*. With such a structure, the man-hour of the coupling process is reduced. Since the number of parts is also reduced, the cost can be reduced.

Figure 18A:
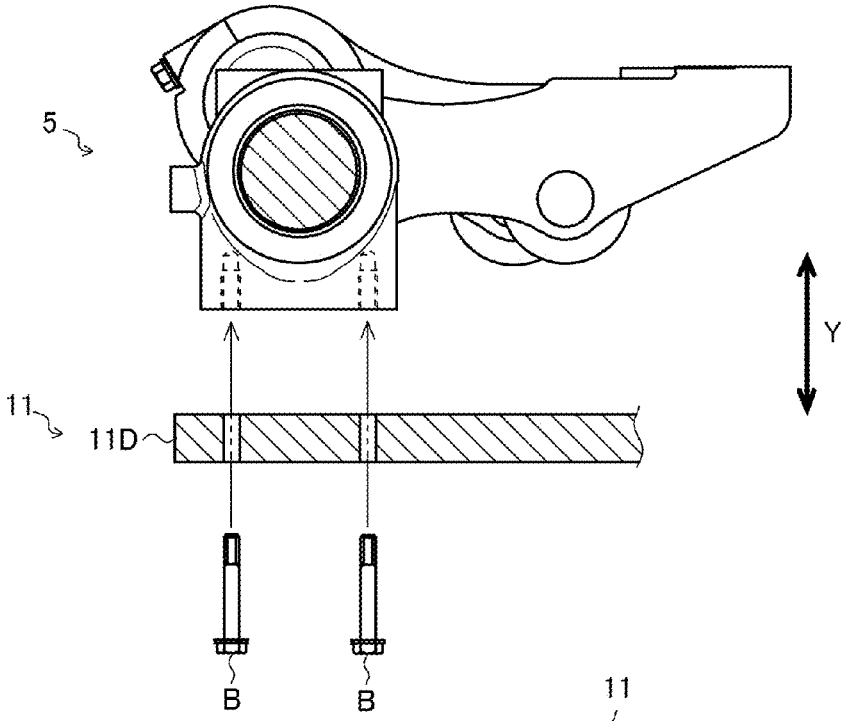
FIGS. 18A and 18B show an attachment position of a variable valve timing system according to one of other embodiments.
Figure 18B:
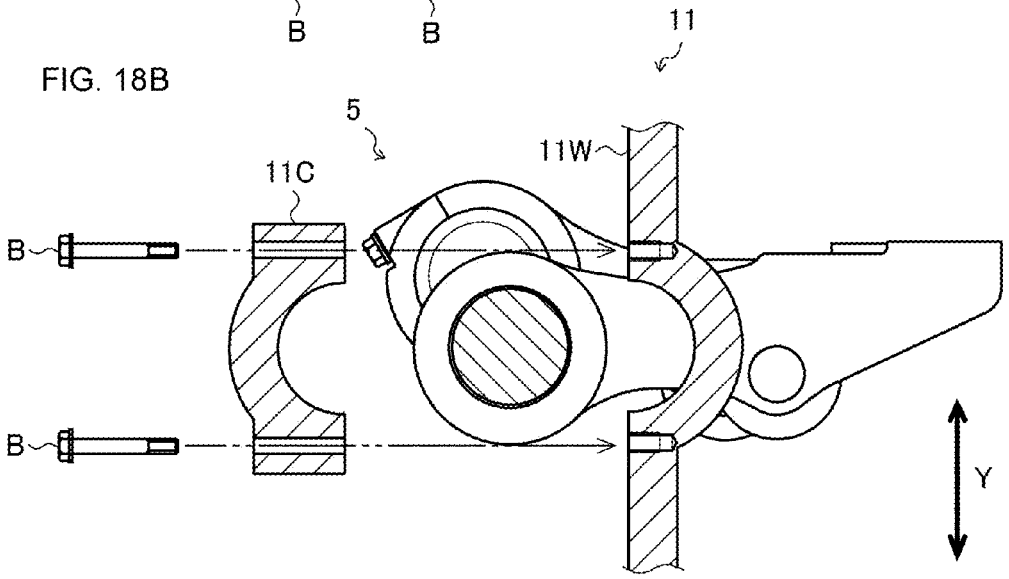

FIGS. 18A and 18B show an attachment position of a variable valve timing system 5 according to one of other embodiments. It should be noted that an arrow Y indicates the up and down direction.

An attachment position shown in FIG. 18A is an upper surface of a deck 11D provided in a cylinder block 11. With such a structure, the variable valve timing system 5 can be placed on the deck 11D. Thus, an assembling task and a disassembling task are easily performed. In this case, the variable valve timing system 5 is fixed to the deck 11D by bolts B via the deck 11D.

An attachment position shown in FIG. 18B is a side wall 11W of a cylinder block 11. With such a structure, the variable valve timing system 5 can be attached to and detached from the side of an engine 100. Thus, the assembling task and the disassembling task are easily performed.

In this case, the variable valve timing system 5 is fixed to the side wall 11W together with a cap 11C by bolts B via the cap 11C.

INDUSTRIAL APPLICABILITY

The present invention is applicable to a technology of a variable valve timing system and an engine including variable valve timing systems.

DESCRIPTION OF REFERENCE SIGNS

100: Engine
1: Main body portion
15: Camshaft
2: Intake route portion
3: Exhaust route portion
4: Fuel supply portion
5: Variable valve timing system
51: Swing shaft
51M: Main shaft portion
51E: Eccentric shaft portion
51*k*: Key
52: Exhaust swing arm
52*b*: Bearing
53: Intake swing arm
53B: Body
53C: Cap
53*b*: Bearing
54: Shaft supporter
54*b*: Bearing
55: Shaft supporter
55*b*: Bearing
56: Circlip
57: Extension shaft
57*k*: Key
58: Universal joint
58*da*: Key groove
58*db*: Key groove
6: Link mechanism
61: Link shaft
62: Link arm
63: Link plate
64: Link rod
7: Actuator
71: Piston rod
72: Main body
8: Stopper
81: Plate
82: Frame
83: Shim

The invention claimed is:

1. A variable valve timing system comprising:
an exhaust swing arm swung in accordance with rotation of a camshaft;
an intake swing arm swung in accordance with the rotation of the camshaft; and
a swing shaft swingably supporting the exhaust swing arm and the intake swing arm,
wherein the swing shaft has an eccentric shaft portion which supports the intake swing arm and which is provided in a main shaft portion supporting the exhaust swing arm, and the main shaft portion is turnably supported by a first shaft supporter adjacent to the eccentric shaft portion and a second shaft supporter disposed away from the first shaft supporter across the intake swing arm and the exhaust swing arm such that the intake swing arm and the exhaust swing arm are disposed in between the first shaft supporter and the second shaft supporter.

2. The variable valve timing system according to claim 1, wherein the main shaft portion and the eccentric shaft portion are integrated.

3. An engine comprising:
a plurality of the variable valve timing systems according to claim 1, wherein the adjacent swing shafts are coupled to each other.

4. The engine according to claim 3, wherein the adjacent swing shafts are coupled via a universal joint.

5. The engine according to claim 3, further comprising:
a link mechanism connected to one of the swing shafts; and an actuator for moving the link mechanism, wherein the actuator controls turning angles of all the swing shafts via the link mechanism.

6. The engine according to claim 5, further comprising:
a stopper in contact with one of the swing shafts, wherein the stopper restricts the turning angles of all the swing shafts.

7. The engine according to claim 6, further comprising:
a shim for adjusting an attachment position of the stopper, wherein by changing the number of the shim, the stopper adjusts the turning angles of all the swing shafts.

8. The engine according to claim 6, wherein the link mechanism is fixed to the swing shaft at a farthest end on one side, and the stopper is disposed in contact with the swing shaft at the farthest end on the other side.

9. An engine comprising:
a plurality of the variable valve timing systems according to claim 2, wherein the adjacent swing shafts are coupled to each other.

10. The engine according to claim 9, wherein the adjacent swing shafts are coupled via a universal joint.

11. The engine according to claim 9, further comprising:
a link mechanism connected to one of the swing shafts; and
an actuator for moving the link mechanism, wherein the actuator controls turning angles of all the swing shafts via the link mechanism.

12. The engine according to claim 11, further comprising:
a stopper in contact with one of the swing shafts, wherein the stopper restricts the turning angles of all the swing shafts.

13. The engine according to claim 12, further comprising:
a shim for adjusting an attachment position of the stopper, wherein by changing the number of the shim, the stopper adjusts the turning angles of all the swing shafts.

14. The engine according to claim 12, wherein the link mechanism is fixed to the swing shaft at a farthest end on one side, and the stopper is disposed in contact with the swing shaft at the farthest end on the other side.

15. An engine comprising:
a first variable valve timing system comprising:
a first exhaust swing arm swung in accordance with rotation of a camshaft;
a first intake swing arm swung in accordance with the rotation of the camshaft; and
a first swing shaft swingably supporting the first exhaust swing arm and the first intake swing arm,
wherein the first swing shaft has an eccentric shaft portion which supports the first intake swing arm and which is provided in a main shaft portion supporting the first exhaust swing arm, and the main shaft portion is turnably supported by a first shaft supporter adjacent to the eccentric shaft portion and a second shaft supporter disposed away from the first shaft supporter across the first intake swing arm and the first exhaust swing arm such that the first intake swing arm and the first exhaust swing arm are disposed in between the first shaft supporter and the second shaft supporter; and a second variable valve timing system comprising:

a second exhaust swing arm swung in accordance with rotation of the camshaft;

a second intake swing arm swung in accordance with the rotation of the camshaft; and a second swing shaft swingably supporting the second exhaust swing arm and the second intake swing arm, wherein the second swing shaft has an eccentric shaft portion which supports the second intake swing arm and which is provided in a main shaft portion supporting the second exhaust swing arm, and the main shaft portion is turnably supported by a third shaft supporter adjacent to the eccentric shaft portion and a fourth shaft supporter disposed away from the third shaft supporter across the second intake swing arm and the second exhaust swing arm such that the second intake swing arm and the second exhaust swing arm are disposed in between the third shaft supporter and the fourth shaft supporter, and wherein the first swing shaft and the second swing shaft are coupled to each other.

* * * * *